US008079359B2

(12) United States Patent
Chung

(10) Patent No.: US 8,079,359 B2
(45) Date of Patent: Dec. 20, 2011

(54) HOOD DEVICE FOR GRILL

(76) Inventor: Joseph K Chung, Norwalk, CA (US)

( * ) Notice: Subject to any disclaimer, the term of this patent is extended or adjusted under 35 U.S.C. 154(b) by 29 days.

(21) Appl. No.: 12/554,269

(22) Filed: Sep. 4, 2009

(65) Prior Publication Data

US 2011/0056478 A1 Mar. 10, 2011

(51) Int. Cl.
*F24C 15/20* (2006.01)

(52) U.S. Cl. ..... 126/299 D; 126/299 R; 126/299 E; 126/21 R; 126/303; 126/80; 454/49; 454/56; 454/57; 454/58

(58) Field of Classification Search ..... 126/299 D, 126/299 R, 21 R, 303, 299 E, 80, 84, 94, 126/153, 154, 49, 65; 454/49, 56, 57, 58, 454/59, 66

See application file for complete search history.

(56) References Cited

U.S. PATENT DOCUMENTS

| | | | | | |
|---|---|---|---|---|---|
| 399,430 | A * | 3/1889 | Neef | 126/301 |
| 879,463 | A * | 2/1908 | Hansen | 126/301 |
| 3,566,585 | A * | 3/1971 | Voloshen et al. | 55/435 |
| 3,596,587 | A * | 8/1971 | Klinger | 126/299 D |
| 3,795,181 | A * | 3/1974 | Lawson | 126/299 E |
| 3,945,812 | A * | 3/1976 | Doane | 95/272 |
| 4,858,591 | A * | 8/1989 | Fu | 126/299 D |
| 6,488,030 | B1 * | 12/2002 | Wardle et al. | 128/845 |
| 6,886,554 | B2 * | 5/2005 | Cheng | 126/299 D |
| 7,581,539 | B2 * | 9/2009 | Aviles | 126/299 D |
| 2004/0099260 | A1 * | 5/2004 | Yum | 126/299 D |
| 2005/0056271 | A1 * | 3/2005 | Cheng | 126/299 D |
| 2007/0079823 | A1 * | 4/2007 | Shin | 126/299 D |

* cited by examiner

*Primary Examiner* — Steven B McAllister
*Assistant Examiner* — Avinash Savani
(74) *Attorney, Agent, or Firm* — John K. Park; Park Law Firm

(57) ABSTRACT

A hood device for grill comprises a hood, a telescoping tubing, a filter assembly, a grease cup, and an external fan. The hood partially covers a grill at a first elevated vertical position and collects smokes from the grill. The telescoping tubing extends from the hood and is configured for ventilating, and telescoping between the first and second positions. The filter assembly is disposed at a lower end of the telescoping tubing, and comprises filter with concentric and cylindrical layers. The grease cup is for collecting grease from the filter. The fan is for building up an ascending air current inside the telescoping tubing. A velocity of the ascending air current is determined according to the first elevated vertical position, a ratio of a diameter of the hood to a diameter of the grill, and a surface temperature of the grill.

19 Claims, 9 Drawing Sheets

HOOD DEVICE FOR GRILL

BACKGROUND OF THE INVENTION

The present invention relates to a hood device for grill. More particularly, this invention relates to a hood device for grill, which collects and ventilates smokes from grill.

A BBQ grill is one of necessities in many countries. However, grilling is related to fire, smoke, and smell. It has been quite challenging to handle the situation around the grill.

Even though some conventional hood devices had been contrived and used, the problems with the smokes and bad smell had not been solved entirely.

Therefore, a need for a hood device for grill has been present for a long time considering the expansive usage of the grill in the everyday life. This invention is directed to solve these problems and satisfy the long-felt need.

SUMMARY OF THE INVENTION

The present invention contrives to solve the disadvantages of the prior art.

An object of the invention is to provide a hood device for grill.

Another object of the invention is to provide a hood device for grill, which collects smokes from grill efficiently and conveniently.

Still another object of the invention is to provide a hood device for grill, which facilitates collection and ventilation of smokes with filter and telescoping tube.

An aspect of the invention provides a hood device for grill.

The hood device for grill comprises a hood, a telescoping tubing, a filter assembly, a grease cup, and an external fan.

The hood partially covers a grill at a first elevated vertical position and collects smokes from the grill.

The telescoping tubing extends from the hood and is configured for ventilating the smokes collected by the hood, and the telescoping tubing is configured to telescope between the first elevated vertical position and a second elevated vertical position, and the telescoping tubing stays at a position until a predetermined magnitude of force is applied to change vertical position.

The filter assembly is disposed at a lower end of the telescoping tubing, and comprises filter with a plurality of concentric and cylindrical layers.

The grease cup is disposed at the bottom of the filter assembly for collecting grease from the filter with the plurality of concentric and cylindrical layers and filtered smokes.

The fan is disposed in an upper portion of the telescoping tubing for building up an ascending air current inside the telescoping tubing and space between the hood and the grill.

A velocity of the ascending air current is determined according to the first elevated vertical position, a ratio of a diameter of the hood to a diameter of the grill, and a surface temperature of the grill.

The diameter of the hood may be smaller than the diameter of the grill. The hood may comprise an insulated handle for lowering and raising the hood. The hood may have a cone shape.

The telescoping tubing may comprise an extension to an external vent. The fan may be disposed in the external vent.

The telescoping tubing may comprise a spring counterbalance device for holding, raising, and lowering the hood smoothly between the first and second elevated vertical positions.

The filter assembly may be configured to filter out grease and dirt from the smokes from the grill.

The grease cup may be detachably engaged with the filter assembly. The grease cup may comprise a bottom surface of a convex shape so as not to impede rising flow of the smokes from below.

The external fan may comprise an operational switch disposed separately. The operational switch of the external fan may be connected to an operational switch of the grill.

The hood may comprise stainless steel. The telescoping tubing may comprise stainless steel.

The grease cup may comprise stainless steel. The grease cup may comprise a reflective bottom surface.

The telescoping tubing may comprise an insulated handle for lowering and raising the hood around the lower end.

The filter of the filter assembly may have a shape of cylinder.

The filter of the filter assembly may have a shape of hemisphere.

The grease cup may be attached to a portion of a lower end of the hemi-spherical filters such that part of the smokes from the grill enters the filter directly.

The advantages of the present invention are: (1) the hood device for grill removes grease and dirt from the smokes from the grill; and (2) the hood device for grill collects grease from the smokes in the grease cup, so as to facilitate to dispose.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

FIGS. 1-9 show a hood device for grill 100 according to embodiments of the present invention.

An aspect of the invention provides the hood device for grill 100 according to an embodiment of the invention.

Figure 1:
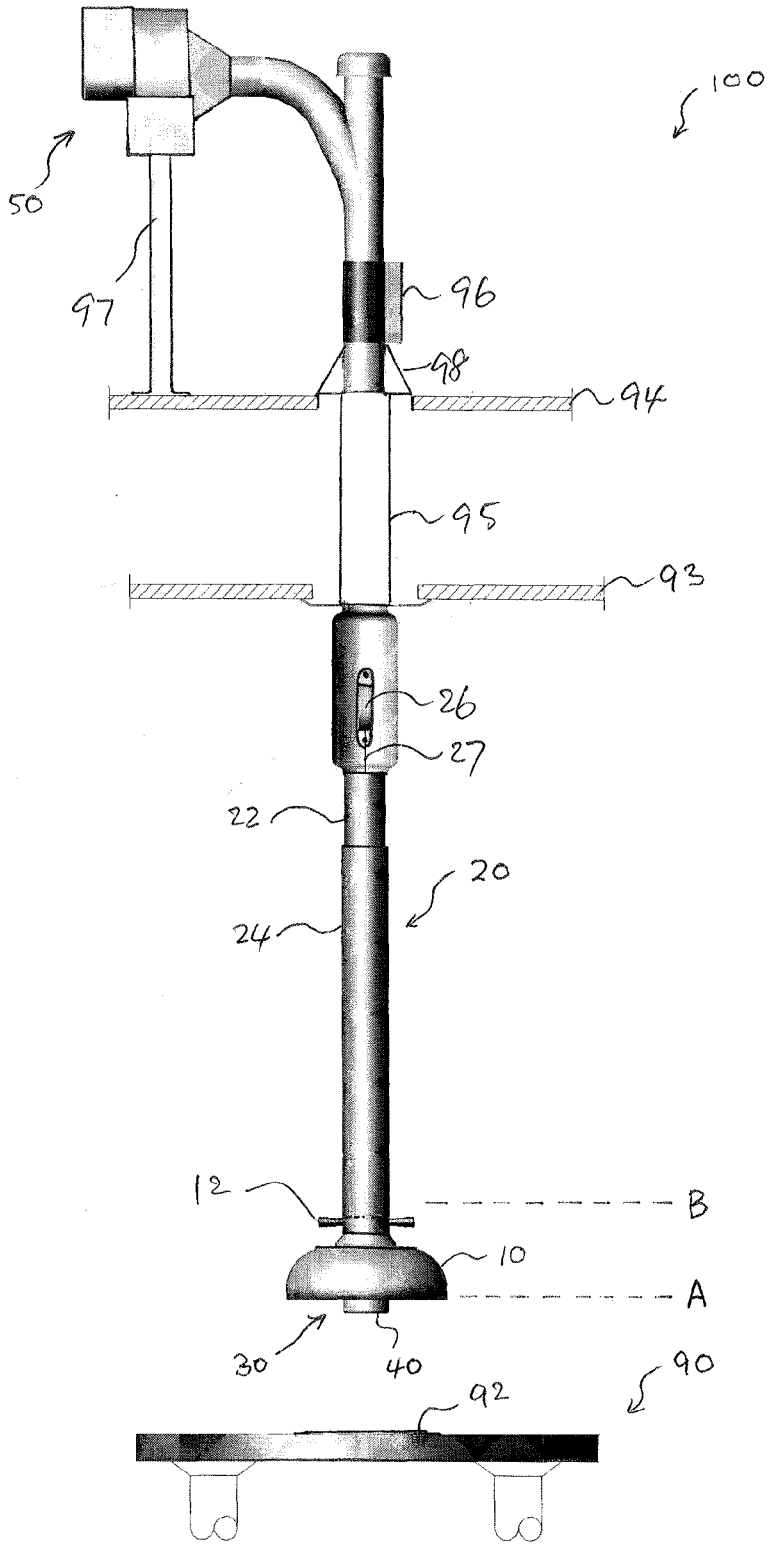
FIG. 1 is a perspective view showing a hood device for grill according to an embodiment of the present invention.

The hood device for grill 100 comprises a hood 10, a telescoping tubing 20, a filter assembly 30, a grease cup 40, and an external fan 50 as shown in FIG. 1.

The hood 10 partially covers a grill 90 at a first elevated vertical position A and collects smokes from the grill 92. The hood 10 has a shape suitable for collecting smokes and hot air rising from the surface of the grill 92.

In a typical hood, the hood 10 has a cone shape. However, the challenging problem is how big it is and how high it would be held. Sometimes the size of the hood 10 may be too big, hindering the users around the grill 10 to see one another.

According to an embodiment of the invention, the hood 10 can be smaller in diameter than the grill surface 90, which is almost against a traditional wisdom on the hood size.

The telescoping tubing 20 extends from the hood 10 and is configured for ventilating the smokes collected by the hood 10, and the telescoping tubing 20 is configured to telescope between the first elevated vertical position A and a second elevated vertical position B, and the telescoping tubing 20 stays at a position including the first elevated vertical position A and the second elevated vertical position B until a predetermined magnitude of force is applied to change vertical position.

The telescoping tubing 20 can be lowered over the grill surface 92 when grilling goes on, and then raised higher when the cooking is done, which may help the user clean up the grill surface 92. The first and second elevated vertical positions A, B can be determined by an overlapping length of the tubing 20. Actually, the telescoping tubing comprises a upper tube 22 and a lower tube 24, and the upper and lower tubes 22, 24 telescope along each other between the first and second elevated vertical positions A, B.

The filter assembly 30 is disposed at a lower end of the telescoping tubing 20, and comprises filter 32 with a plurality of filtering layers 34. The filtering layers 34 may be concentric and cylindrical. The filters layers 34 of the filter 32 are suitable to filter out grease, dirt, or debris in the smokes. In a certain embodiment of the invention, the filter 32 is made of stainless steel.

The grease cup 40 is disposed at the bottom of the filter assembly 30 for collecting grease from the filter 32 with the plurality of concentric and cylindrical layers and filtered smokes. Usually, the smokes contain grease, dirt, or debris from fat burning, flying ash, soot, etc. These impurities can be filtered out before ventilation through the telescoping tubing 20, but may fall down on the grill 90 again, which can cause a lot of secondary smokes and polluting foods on the grill surface 92. The grease cup 40 is configured to catch and collect these impurities.

Once collected substantially, the grease cup 40 may be detached from the filter assembly 30 to empty or spill out the grease and impurities.

The size of the grease cup 40 may be determined by an estimated amount of grease collected from grilling, such that the grease cup 40 does not have to be emptied in the middle of grilling.

The fan 50 is disposed in an upper portion of the telescoping tubing 20 for building up an ascending air current inside the telescoping tubing 20 and space between the hood 10 and the grill 92.

A velocity of the ascending air current is determined according to the first elevated vertical position A, a ratio of a diameter of the hood 10 to a diameter of the grill 92 or the grill surface 92, and a surface temperature of the grill 90. The higher the grill surface temperature is, the larger the ratio is going to be, for example.

The diameter of the hood 10 may be smaller than the diameter of the grill 92. The hood 10 may comprise an insulated handle 12 for lowering and raising the hood 10. Alternatively, the insulated handle 12 may be installed at a lower portion of the telescoping tubing 20 as shown in FIG. 1. The hood 10 may have a cone shape. As discussed in the above, the size of hood 10 may affect the convenience of the users by interfering sight. The size of the hood 10 may be reduced by much, for example, if the power of the external fan 50 is elevated.

However, since the fluid dynamics and the turbulent flow factors govern the dispersing degree of the rising smokes, the hood size must be determined considering many factors of the hood device 100 as a whole, and further the air flow of a room in which the grill 90 is installed.

The telescoping tubing 20 may comprise an extension to an external vent. Alternatively, the fan 50 may be disposed in the external vent as long as the fan 50 can build a raising current of air inside the tubing 20. By installing the external fan 50 in the external vent disposed outside of the room, the noise level may be reduced to a minimum in a certain embodiment of the invention.

The telescoping tubing 20 may comprise a spring counterbalance device 26 for holding, raising, and lowering the hood 10 smoothly between the first and second elevated vertical positions A, B.

The telescoping tubing 20 may be raised, lowered with the handle 12 disposed in the hood 10 or the telescoping tubing 20, or stopped in a certain position between the first and second elevated vertical positions A, B. If it is held still for a short time, the telescoping tubing 20 does not move further until a predetermined magnitude of force is applied.

The filter assembly 30 may be configured to filter out grease and dirt from the smokes from the grill 92 as shown in FIGS. 3-6. In a certain embodiment of the invention, the material and size of the filter assembly 30 can be adjusted to an optimal value according to the amount of smokes from below or the power or temperature of the grill surface 92.

The grease cup 40 may be detachably engaged with the filter assembly 30. The grease cup 40 may comprise a bottom surface of a convex shape so as not to impede rising flow of the smokes from below. Since the usual grill surface is not that hot, the air flow of the smokes may not be interfered seriously. However, by making the bottom of the grease cup 40 with streamlined, it may be possible to facilitate the flow of the smokes into the filter assembly 30.

The external fan 50 may comprise an operational switch (not shown) disposed separately. The operational switch of the external fan 50 may be connected to an operational switch (not shown) of the grill 90. Thereby, the external fan 50 may be powered concurrently with the grill surface 92.

The hood 10 may comprise stainless steel. The telescoping tubing 20 may comprise stainless steel. In certain embodiments of the invention, the hood 10 and the telescoping tubing 20 may be made of other strong material which can withstand heat of the grill surface 92.

The grease cup 40 may comprise stainless steel. The grease cup 40 may comprise a reflective bottom surface, which can reflect radiation from the grill surface 92 for not catching much heat.

The telescoping tubing 20 may comprise an insulated handle 12 for lowering and raising the hood 10 around the lower end.

Figure 9:
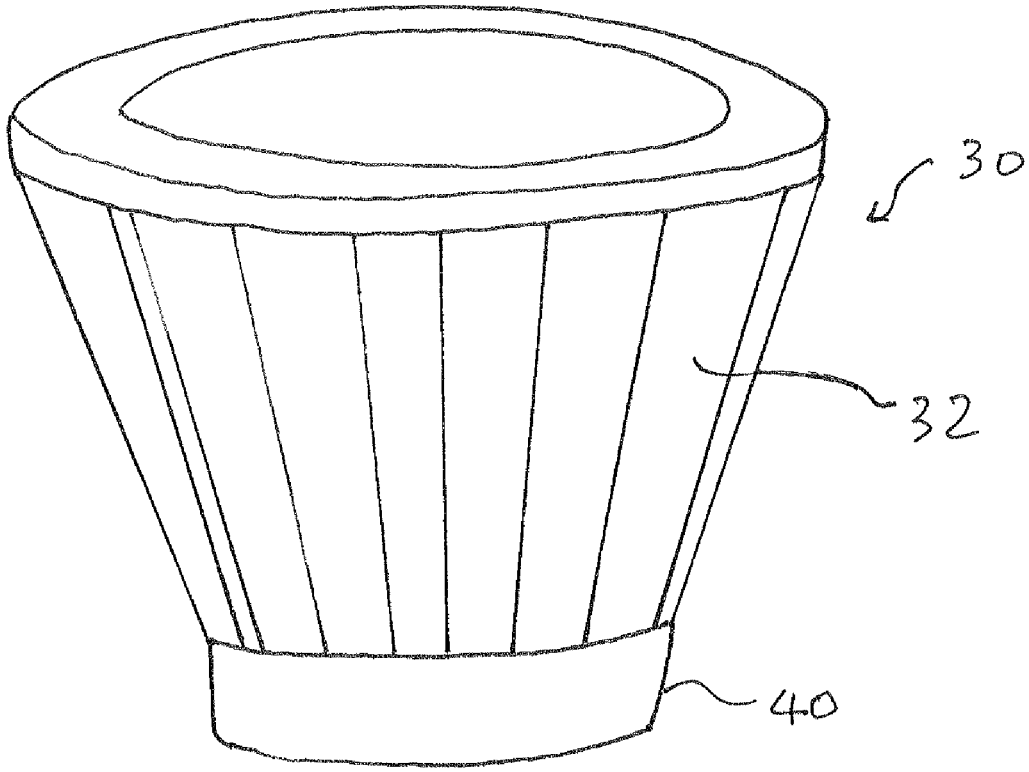
FIG. 9 is a front plan view of a filter assembly according to an embodiment of the invention.

The filter 32 of the filter assembly 30 may have a shape of cylinder. Alternatively, the filter 32 of the filter assembly 30 may have a shape of hemi-sphere. The grease cup 40 may be attached to a portion of a lower end of the hemi-spherical filters such that part of the smokes from the grill enters the filter directly as shown in FIG. 9.

In FIG. 1, the tubing 20 may further comprise a fire rated ceiling 93, a roof 94, a fire barrier duct wrap 95, and pipe clamps 96. The fan 50 may further comprise a blower support 97, roof flashings 98. The spring counterbalance device 26 may comprise a wire rope 27 as shown in FIGS. 1 and 2.

Figure 2:
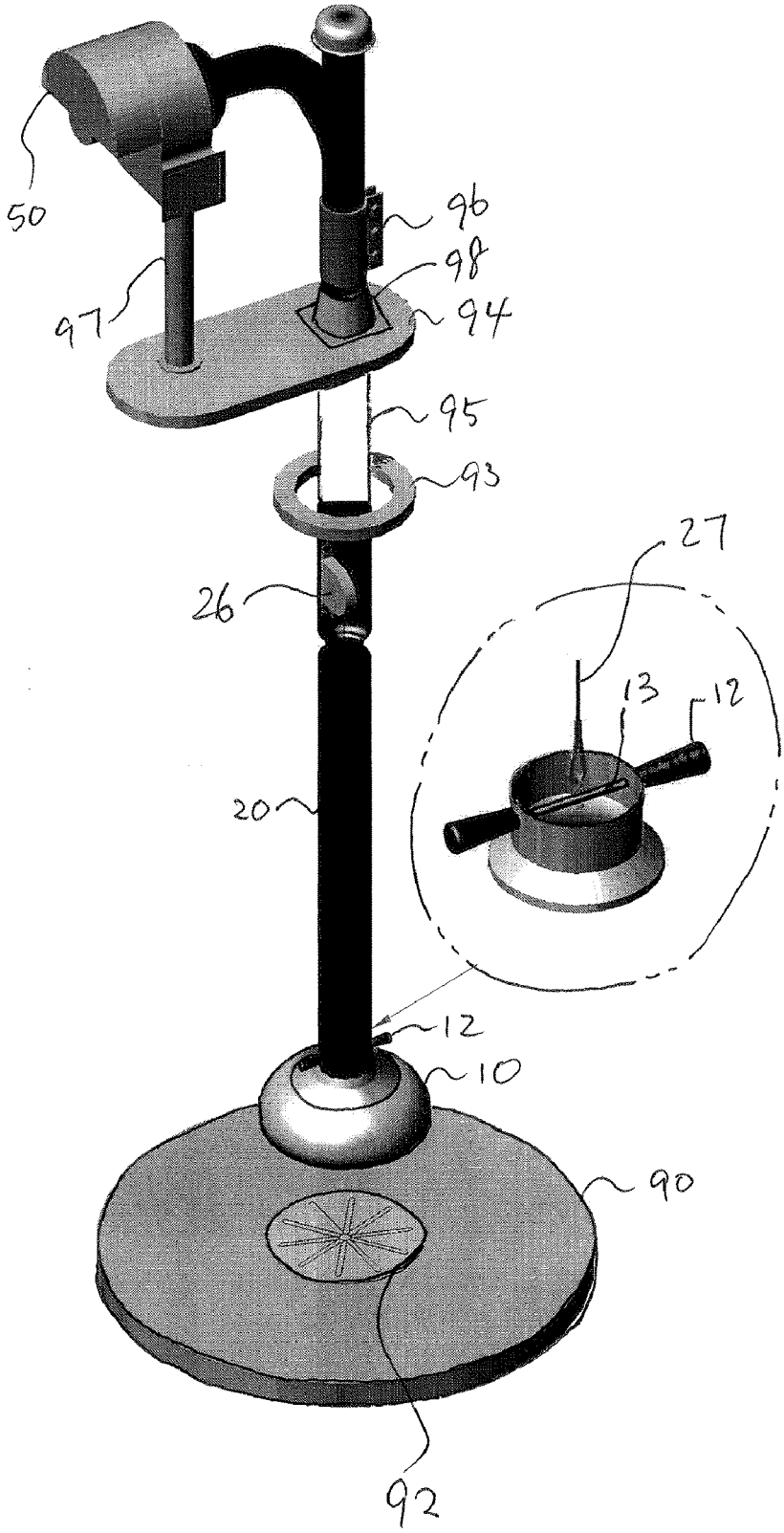
FIG. 2 is another perspective view showing a hood device for grill according to another embodiment of the present invention.
Figure 3:
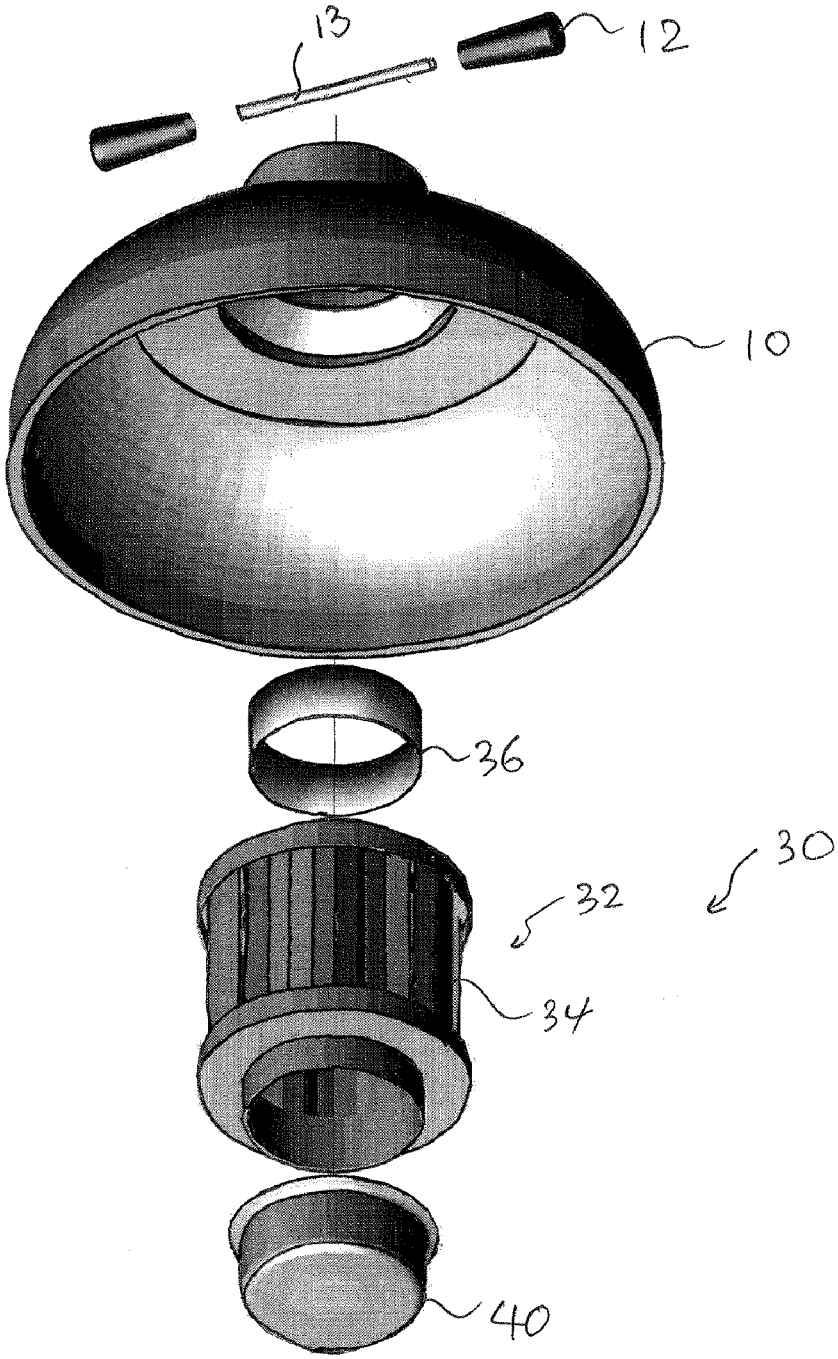
FIG. 3 is an exploded view of a hood device for grill according to an embodiment of the present invention.

In FIGS. 2 and 3, a top connecting portion 36 for connecting the filter assembly 30 to the tubing 20 may be provided at a lower end of the tubing 20 as a part of the tubing 20. The wire rope 27 may be connected to the insulated handle 12 through a bar 13.

Figure 4:
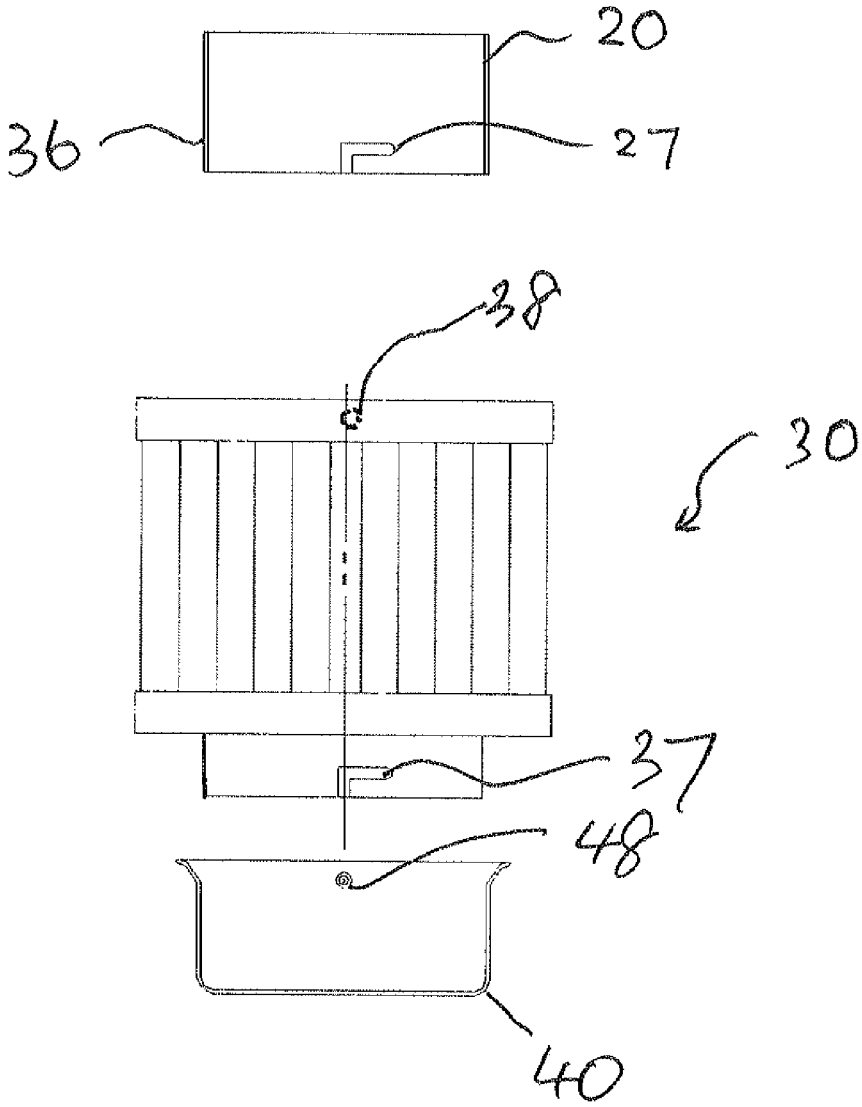
FIG. 4 is an exploded view of a filter for a hood device for grill according to an embodiment of the present invention.

In FIG. 4, the tubing 20 may comprise a connecting twist-lock L-shaped groove 27, and the filter assembly 30 may comprise a plurality of connecting humps 38 disposed inside a top portion of the filter assembly 30, the connecting humps 38 being configured to be connected to the connecting twist-lock L-shaped groove 27. Similarly, the filter assembly 30 may further comprise a connecting twist-lock L-shaped groove 37 at a lower portion, and the grease cup 40 may comprise a connecting hump 48 configured to be connected to the connecting twist-lock L-shaped groove 37.

Figure 5:
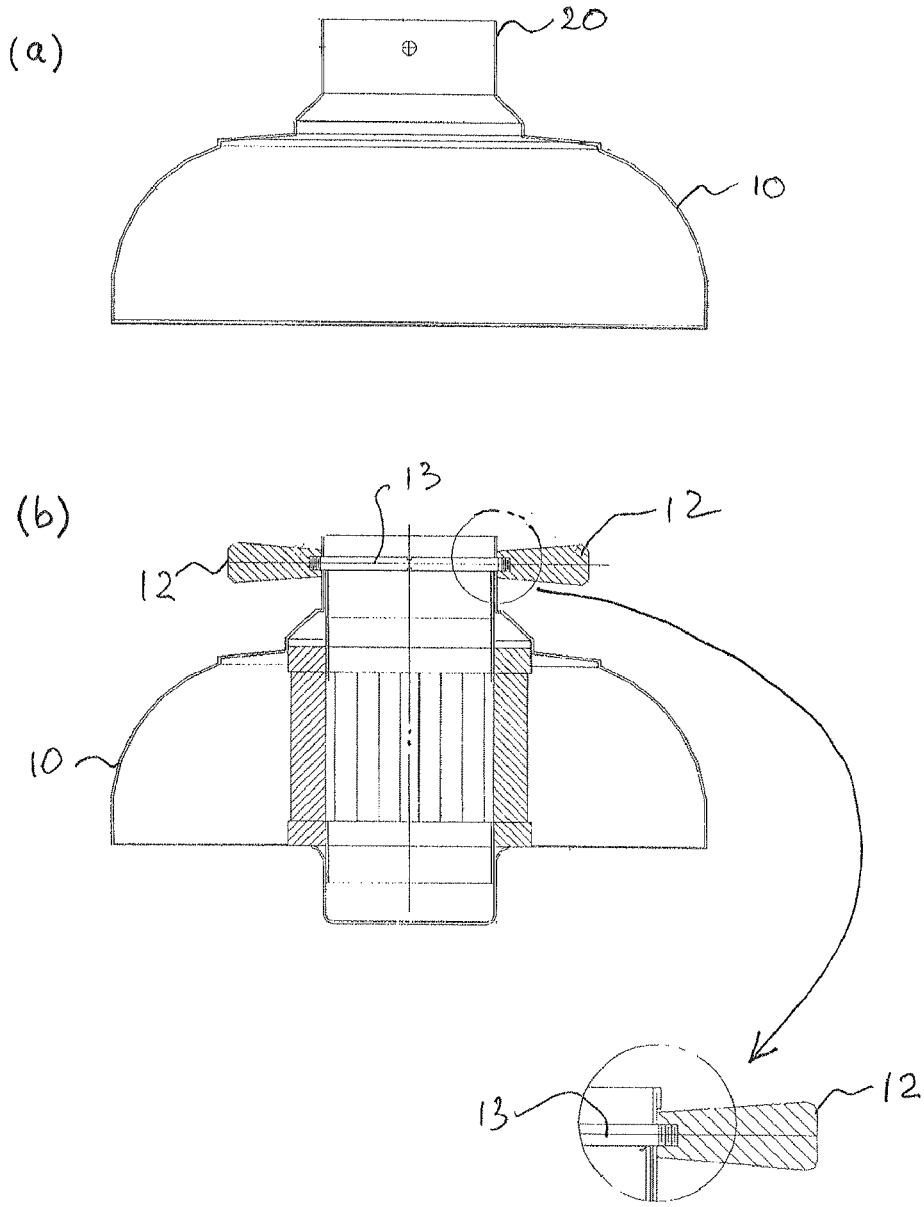
FIGS. 5(*a*)-(*b*) are a front plan view and a cross-sectional view of a hood device for grill.

In FIGS. 5(*a*)-(*b*), the insulated handle 12 is connected to the bar 13 which is connected to the tubing 20.

Figure 6:
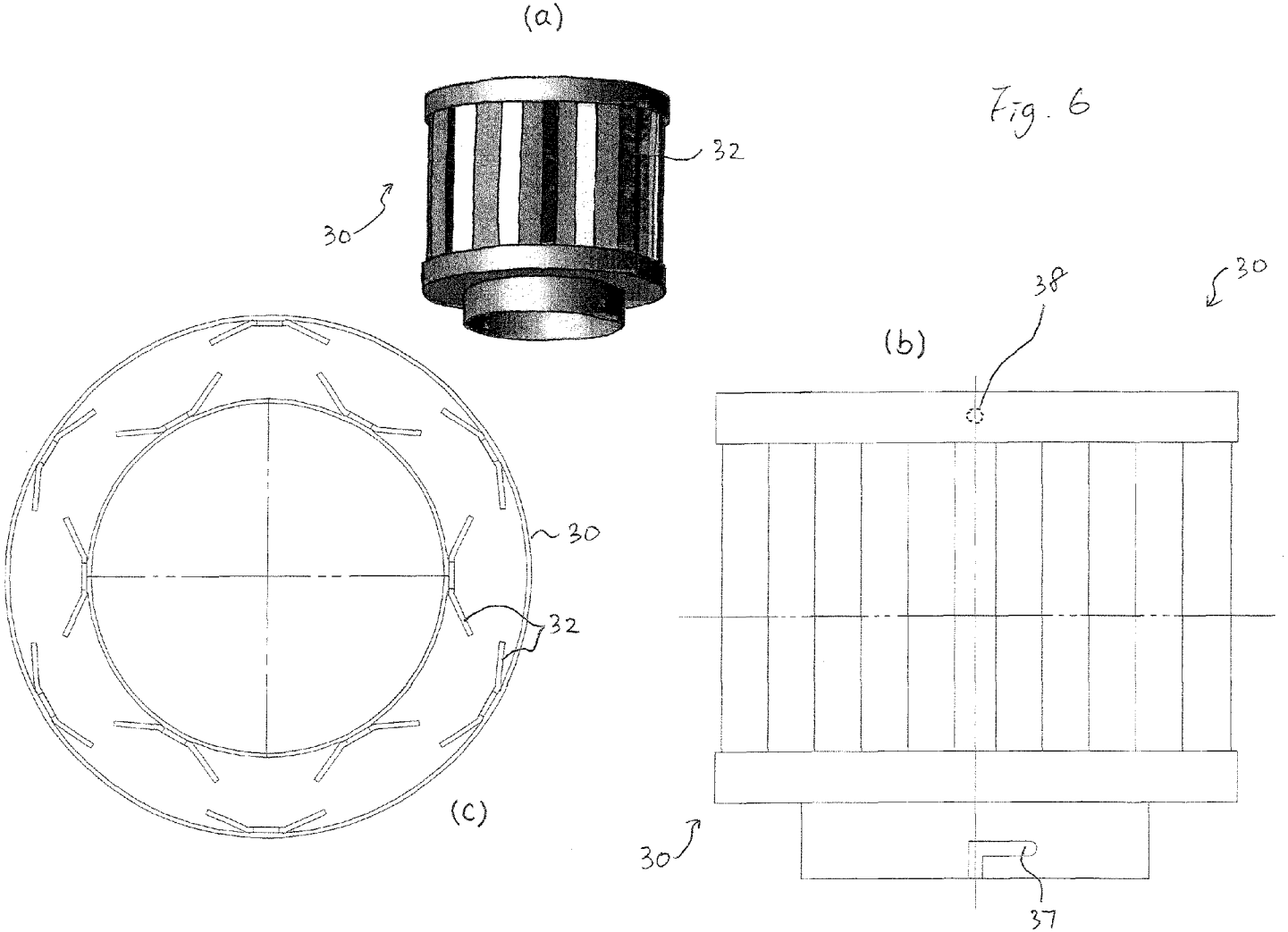
FIGS. 6(*a*)-(*c*) are a perspective view, a front plan view, and a top plan view of a hood device for grill according to an embodiment of the present invention, respectively.

In FIGS. 6(*a*)-(*c*), the filter assembly 30 comprises the filter 32 with the plurality of filtering layers 34. The filtering layers 34 are not limited to the illustrated one.

Figure 7:
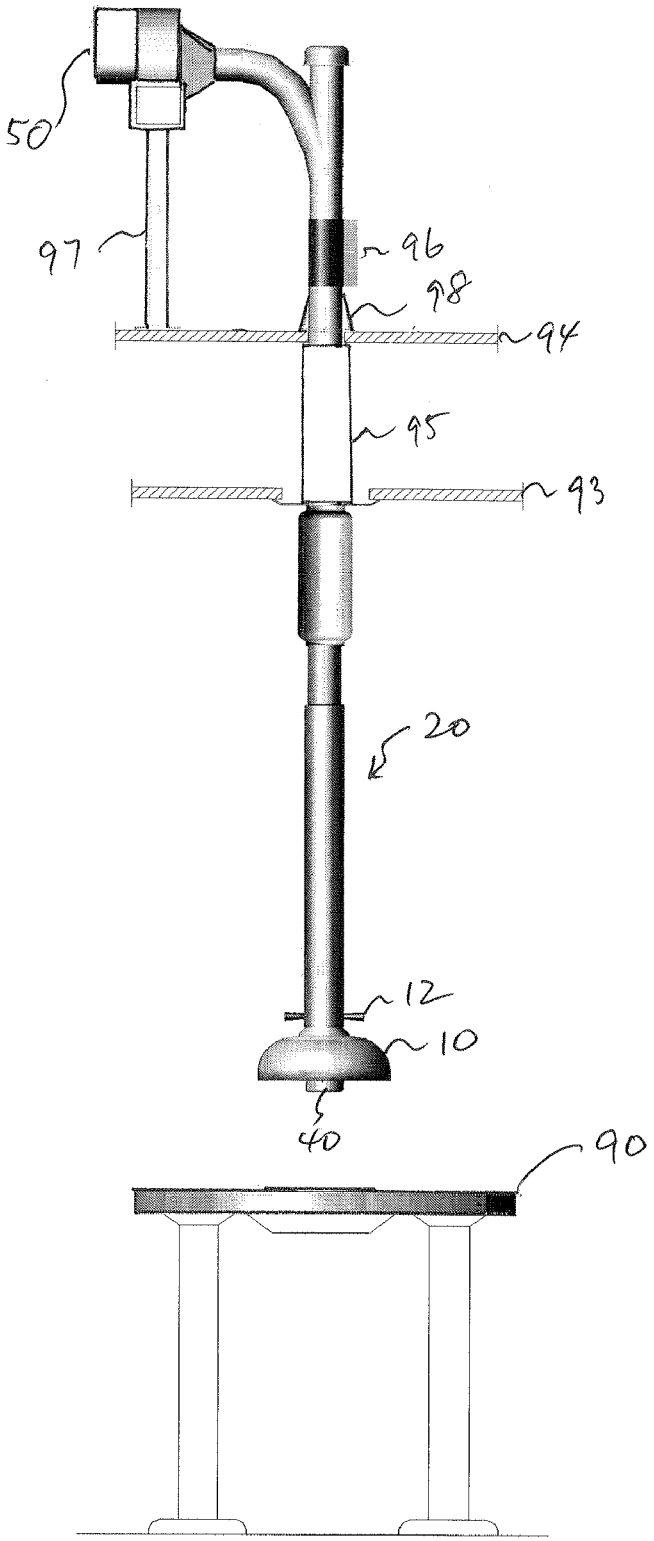
FIG. 7 is a perspective view of a hood device for grill installed over a grill according to an embodiment of the present invention.
Figure 8:
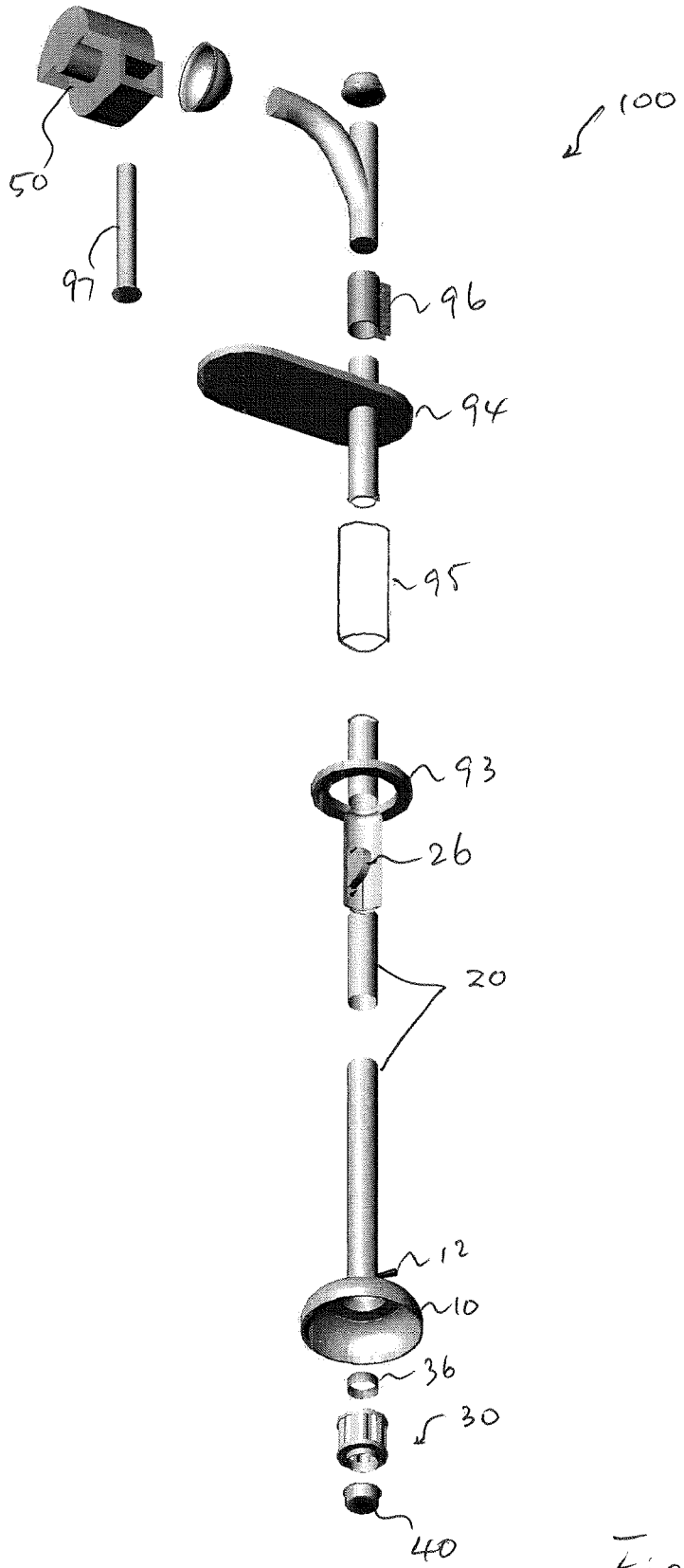
FIG. 8 is an exploded view of a hood device for grill according to an embodiment of the present invention.

FIGS. 7 and 8 show the hood device for grill 100 according to an embodiment of the invention.

FIG. 9 shows a front plan view of a filter assembly 30 according to an embodiment of the invention. The filter assembly 30 may comprise the filter 32 with the plurality of filtering layers 34. Even though the general shape is different from the one in FIGS. 6(*a*)-(*c*), the basic structure and function is same. The filters 32 are actually strips of stainless strips. The edges of the inner stainless strips are bent outward, and those of the outer stainless strips are bent inward, which are configured to introduce smoke from outside and guide them to collide against the themselves, such that the smoke precipitates debris and fatty oils in them. In FIG. 9, the stainless strips may have shapes of trapezoid extended vertically to fit the dimension of the filter assembly 30.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A hood device for a grill comprising:

a hood for partially covering a grill at a first elevated vertical position and collecting smokes from the grill;

a telescoping tubing extending from the hood and configured for ventilating the smokes collected by the hood, wherein the telescoping tubing is configured to telescope between the first elevated vertical position and a second elevated vertical position, and wherein the telescoping tubing stays at a position until a predetermined magnitude of force is applied to change vertical position;

a filter assembly disposed at a lower end of the telescoping tubing, comprising filter with a plurality of concentric and cylindrical layers;

a grease cup disposed at the bottom of the filter assembly for collecting grease from the filter with the plurality of concentric and cylindrical layers and filtered smokes;

a fan disposed in an upper portion of the telescoping tubing for building up an ascending air current inside the telescoping tubing and space between the hood and the grill; and an insulated handle for lowering and raising the hood wherein velocity of the ascending air current is determined according to the first elevated vertical position, a ratio of a diameter of the hood to a diameter of the grill, and a surface temperature of the grill, wherein the layers for the filter comprise inner strips and outer strips arranged intermediately, wherein the telescoping tubing comprises a spring counterbalance device for holding, raising, and lowering the hood smoothly between the first and second elevated vertical positions;

wherein the spring counterbalance device further comprises a wire rope which is connected to the insulated handle through a bar.

2. The hood device for a grill of claim 1, wherein the diameter of the hood is smaller than the diameter of the grill.

3. The hood device for a grill of claim 1, wherein the hood has a cone shape.

4. The hood device for a grill of claim 1, wherein the telescoping tubing comprises an extension to an external vent.

5. The hood device for a grill of claim 4, wherein the fan is disposed in the external vent.

6. The hood device for a grill of claim 1, wherein the filter assembly is configured to filter out grease and dirt from the smokes from the grill.

7. The hood device for a grill of claim 1, wherein the grease cup is detachably engaged with the filter assembly.

8. The hood device for a grill of claim 7, wherein the grease cup comprises a bottom surface of a convex shape so as not to impede rising flow of the smokes from below.

9. The hood device for a grill of claim 1, wherein the external fan comprises an operational switch disposed separately.

10. The hood device for a grill of claim 9, wherein the operational switch of the external fan is connected to an operational switch of the grill.

11. The hood device for a grill of claim 1, wherein the hood comprises stainless steel.

12. The hood device for a grill of claim 1, wherein the telescoping tubing comprises stainless steel.

13. The hood device for a grill of claim 1, wherein the grease cup comprises stainless steel.

14. The hood device for a grill of claim 13, wherein the grease cup comprises a reflective bottom surface.

15. The hood device for a grill of claim 1, wherein the telescoping tubing comprises an insulated handle for lowering and raising the hood around the lower end.

16. The hood device for a grill of claim 1, wherein the filter of the filter assembly has a shape of cylinder.

17. The hood device for a grill of claim 1, wherein the filter of the filter assembly has a shape of hemi-sphere.

18. The hood device for a grill of claim 17, wherein the grease cup is attached to a portion of a lower end of the hemi-spherical filters such that part of the smokes from the grill enters the filter directly.

19. The hood device for a grill of claim 1, wherein the inner strips are bent outward and outer strips are bent inward.

* * * * *